United States Patent [19]

Yoshida et al.

[11] 4,187,063

[45] Feb. 5, 1980

[54] AIR MOTOR WITH DISCHARGE THROUGH GEAR CHAMBER AND SILENCER

[75] Inventors: Dan Yoshida, Osaka; Tatsumi Onaka, Amagasaki; Yasuhiro Horiuchi, Ikoma, all of Japan

[73] Assignees: Fuji Kuuki Kabushiki Kaisha; Hitachi Zosen Kabushiki Kaisha, both of Osaka, Japan

[21] Appl. No.: 850,488

[22] Filed: Nov. 10, 1977

[51] Int. Cl.[2] ..... F01C 13/02; F01C 21/04; F01C 21/06

[52] U.S. Cl. ..... 418/90; 418/100; 418/102; 418/181; 418/270

[58] Field of Search ..... 418/90, 100, 102, 181, 418/270; 415/503; 181/230

[56] References Cited

U.S. PATENT DOCUMENTS

| | | | |
|---|---|---|---|
| 2,925,089 | 2/1960 | Conklin et al. | 415/503 |
| 2,946,315 | 7/1960 | Doeden | 181/230 |
| 3,700,363 | 10/1972 | Sorensen et al. | 418/270 |
| 3,814,209 | 6/1974 | Inoue | 181/230 |

FOREIGN PATENT DOCUMENTS

| | | | |
|---|---|---|---|
| 982347 | 1/1951 | France | 418/90 |

*Primary Examiner*—John J. Vrablik

*Attorney, Agent, or Firm*—Wenderoth, Lind & Ponack

[57] ABSTRACT

An air motor includes an arrangement such that a part of an exhaust air from a cylinder of the air motor passes through a gear chamber containing a gear mechanism which links a gear fixed to a shaft directly connected to a rotor with a power output shaft and is discharged through a silencer.

1 Claim, 6 Drawing Figures

AIR MOTOR WITH DISCHARGE THROUGH GEAR CHAMBER AND SILENCER

BACKGROUND OF THE INVENTION

The present invention relates to an air motor having increased durability without lowering the transmitting function of a gear mechanism of its power output means.

SUMMARY OF THE INVENTION

Generally, a gear mechanism of a power output means of an air motor is placed in a sealed gear chamber and is lubricated mainly with grease. Now, a rotary machine to be driven by an air motor is different from a rotary machine to be driven by a general motor with respect to rotation at a high speed. Therefore, it is always necessary to check the gear mechanism provided in a power output means of the motor. However, it is usually impossible to easily check the gear mechanism from outside, and thus checking is often neglected until such time as trouble occurs, such as caused by a strange noise or generation of heat. Consequently, the gears are damaged and unsuitable for further use.

When inquiring into the cause of such trouble, the following matters can be considered. Grease having been applied to the gears is dispersed therefrom to other parts mainly by a centrifugal effect caused by a high speed rotation of the machine, and the surfaces of the gears become short of lubrication, and accordingly the gear mechanism generates heat. Also, the gear mechanism and its casing have no particular means for radiating heat, and therefore the temperature of the gear surfaces rises as the time of operation increases, and thus the gears are damaged by heat and are worn away.

Compressed air (hereinafter referred to merely as air) which is used in general sometimes contains a large amount of moisture due to insufficient dehydrating means. Consequently, machines to be driven by an air motor are designed to discharge exhaust air without utilizing it any further.

This is because there is such a consideration that if a moisture containing exhaust air is led into the gear mechanism, it would wash away any oil or a grease applied thereto and would damage the gears.

However, as regards moisture in air, all the air compressors conforming to the present industrial standards are provided with a perfect dehydrating means, and therefore the air to be supplied from such compressors contains almost no moisture. Further, in a factory installed air line which conforms to the present industrial standard, there is provided an oiler so as to mix a mist of lubricant into the air. Therefore, by leading such air from an air exhausting part of a rotor to a gear chamber, it is possible to achieve spray lubrication and air cooling at the same time.

To explain the action of air in a motor, air having a pressure of 7 kg/cm$^2$ produced in an air line is consumed by 1.3 m$^3$/min., supposing the output of the motor to be 1.5 p.s. and it loses an amount of heat which corresponds to the output and thus the temperature of the exhaust air comes down to about 0° C.

The present invention has been made in consideration of the abovementioned matters. Its object is to produce an air motor which has increased durability by leading a part of the exhaust air from a cylinder of the air motor into a gear chamber and by cooling gears directly with an oil containing air of low temperature.

For this purpose, in the present invention there is provided an oiler at an appropriate place in an air supplying passage, which leads to a gear chamber, in order to positively mix a suitable amount of lubricant with the air. Thus, it is designed to achieve lubrication of the gears and cooling of the gears at the same time by using an oil containing air of low temperature.

BRIEF DESCRIPTION OF THE DRAWINGS

The abovementioned object and advantages of the present invention will be explained further in detail in the following description, with reference to the attached drawings, wherein.

DETAILED DESCRIPTION OF THE INVENTION

Figure 1:
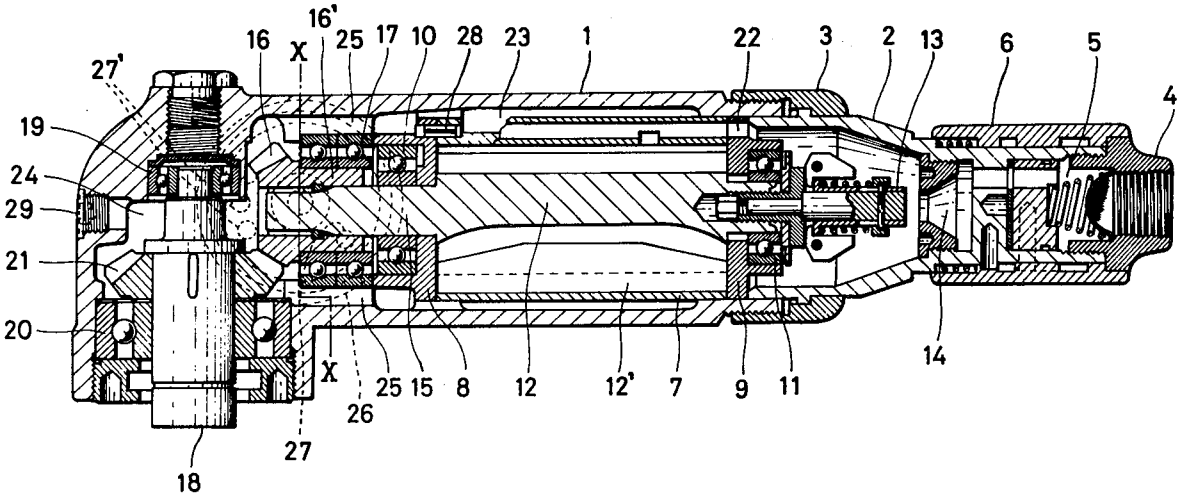
FIG. 1 is a vertical sectional front view of the machine.

The present invention is described in detail below with reference to the drawings attached hereto.

What is shown in FIGS. 1–4 is an air motor of a type in which an output shaft projects and crosses at right angles with respect to a motor shaft line.

A main body 1 includes an L-shaped chamber, and a body cover 2 is fixed at a rear opening of the main body by a double nut 3. At the end of the body cover 2 there is provided a joint 4, which is connected with a compressor (not shown in the drawings) through a hose. Further, at the end of the body cover 2 there is provided an air supply valve 5, which is operated by a grip-type handle 6. Within the middle part of the main body 1 there is provided a cylinder 7 forming a rotor chamber containing a rotor 12 of a known structure, which is supported by a front cylinder cover 8 and a rear cylinder cover 9 through bearings 10 and 11, respectively, and which has a number of blades 12' on its circumference in such manner as they can freely project and retract. At the end of a rear shaft of rotor 12 there is provided a speed control valve 13 positioned to face a compressed air inlet 14 which is linked with the air supply valve 5. To the end of a front shaft 15 of the rotor 12 there is fixed a driving bevel gear 16, a boss 16' of which is supported by a bearing 17 provided in the main body 1.

Figure 2:
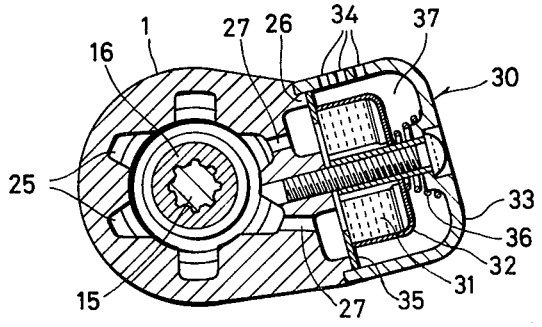
FIG. 2 is a cross sectional view along line II—II in FIG. 1.
Figure 3:
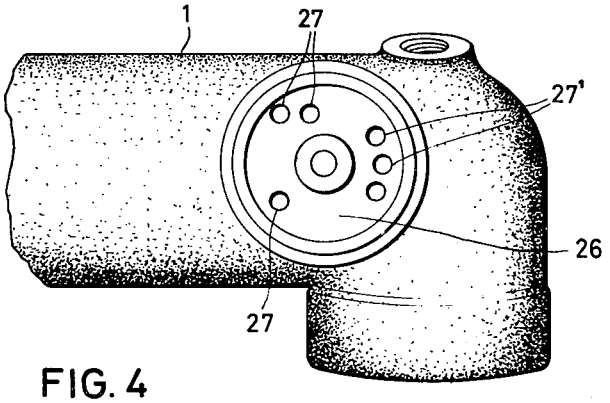
FIG. 3 is a front view of the exhaust hole.
Figure 4:
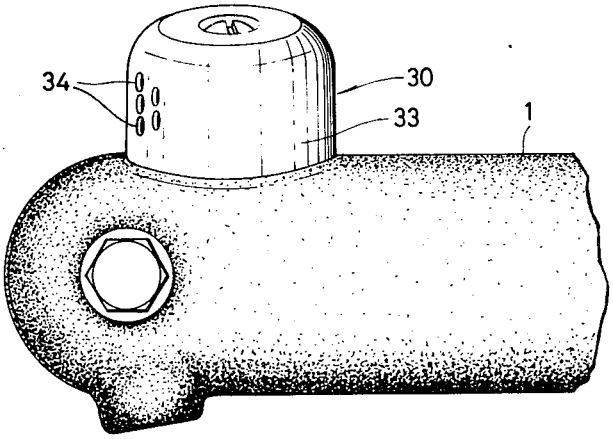
FIG. 4 is an oblique plan view of the left-hand part of the machine shown in FIG. 1.

At the front part of the main body 1, an output shaft 18 is mounted onto the main body 1 through bearings 19, 20 in such manner that it extends at a right angle with the center line of the shaft of the rotor, that it can rotate freely and that one of its ends projects from the main body. A passive bevel gear 21 is made to engage with the active bevel gear 16. The air supply to the cylinder 7 is achieved by leading air from the body cover 2 to a hole 22 of the rear cylinder cover 9 and then to a known air supplying hole provided in the cylinder 7. A number of connecting holes 25 are provided in the direction of the shaft line of the rotor so that the exhaust air from the cylinder can flow from an air exhausting hole (not shown in the drawings) of the cylinder 7 to a gear chamber 24 through a gap 23 formed between the cylinder 7 and the main body 1. A fixing seat 26 for a silencer 30 provided on one side of the main body 1 has extending therethrough a number of holes 27 which correspond to the connecting holes 25. Further, a number of exhaust holes 27' extend from the gear chamber 24 to fixing seat 26. As shown in FIG. 2, the silencer 30 is made by enclosing a filling 31, which has a sound arresting function, with a cover 32 having ventilating holes, by holding it in a stationary state, by covering it further with an exhaust cover 33 having exhaust air discharging holes 34 formed in a specific direction, and by fixing the whole to the main body 1.

Further, 35 is a plate, 36 is a spring to press cover 32, 37 is a buffering chamber, 28 is a fixing pin, and 29 is a plug.

Under such construction, air comes into the cylinder 7 from the air supplying means, rotates the rotor 12, passes from the exhaust hole to the connecting holes 25 through the gap 23, and then flows from the exhaust hole 27 directly into the silencer 30. Also, part of the air flows from the connecting holes 25 to the gear chamber 24, cools bevel gears 16 and 21, flows from the exhaust hole 27' provided in the gear chamber 24 in the silencer 30, where its sound is arrested, and is finally discharged outside. The air coming from the cylinder 7 contains oil mist, so that the gears are lubricated and cooled by the cold air flown into the gear chamber.

Figure 5:
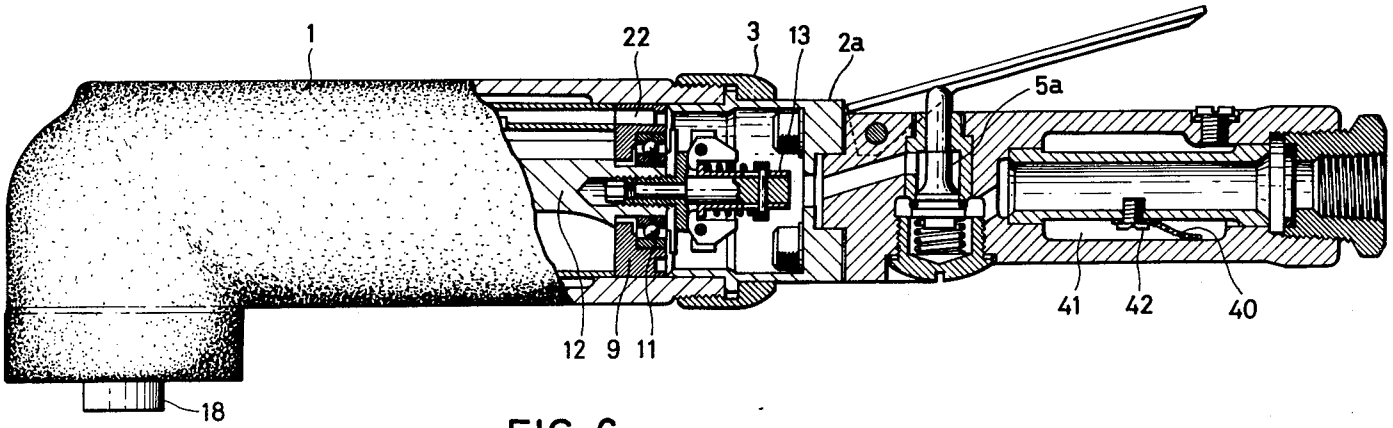
FIG. 5 is a front view, partially in section, of an important part of another embodiment of the machine.
Figure 6:
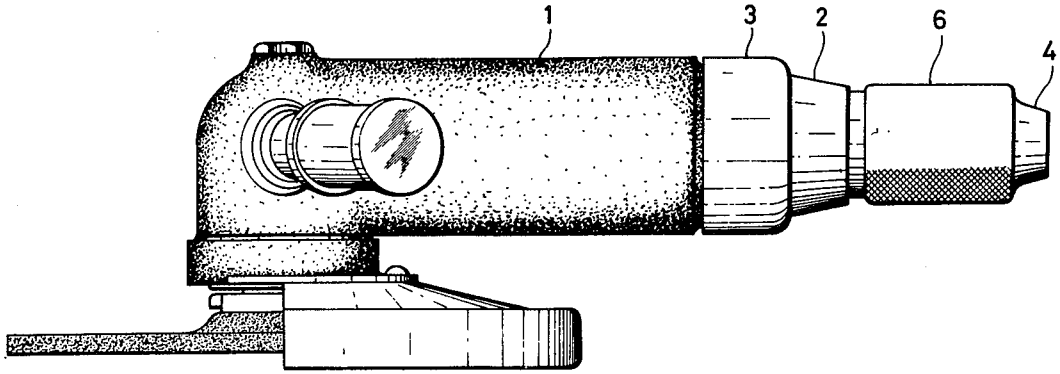
FIG. 6 is a front view illustrating an example of the machine in use.

Generally, the air to be supplied to the motor contains an appropriate amount of lubricant. Such mixture is achieved as follows. As shown in FIG. 5, one end of a lubricant supplying wick 40 is provided in an air supplying passage running toward an air supply valve 5*a* fixed to a rear cover 2*a* of the main body 1, and the other end of wick 40 extends into oil in oil chamber 41. By utilizing a capillary phenomenon, oil is positively sucked up from lubricant oil chamber 41 into the air supplying passage. Thus, since it is oil-containing air, the exhaust air can carry out more effectively the rotation of the rotor and the lubrication and cooling of the gear mechanism. The wick is held in place by a screw 42 to thus form and oil supplying means.

As an alternative method of mixing a lubricant into the air, it may be possible to provide an oil suction means at an appropriate place in the air supplying passage or, as occasion demands, at a certain part of the connecting hole 25 leading to the gear chamber so that a suitable amount of oil is sucked up from an oil tank provided outside the main body 1 and is mixed with the air flowing toward the gear chamber.

As has been described above, the air motor of the present invention has such function that a part of the exhaust air after having rotated the rotor is led into the gear chamber to cool gears and then is discharged through the silencer. This shows that, without making the structure of the machine complicated, it is possible to lubricate and cool gears directly with an oil-containing air of low temperature and thus to prevent the gears from overheating, as could otherwise be caused by high speed rotation. Accordingly, if the present invention is applied to an air rotary machine which is operated for a comparatively long time and yet harshly, it is possible to substantially prolong the durability of the machine. In comparison tests using a known grinder structure, it has been confirmed that a grinder which the present invention is applied can prolong the life of the gear mechanism ten times or more, compared with the known structure.

The example of the present invention given in the foregoing paragraphs shows a structure which is suitable to a rotary air machine such as a grinder of the angle type. However, the present invention can be applied equally effectively and easily to an air motor of the stationary type or the mobile type, in which a spur gear or a helical gear is used as a gear to be fixed to the end of the rotor shaft and a gear mechanism which increases or decreases speed through a gear engaging with such spur gear or helical gear is accomodated either in the main body or in a gear casing attached to the main body.

What is claimed as:

1. An air motor comprising:

a casing having therein a rotor chamber and a gear chamber;

a rotor positioned within said rotor chamber and having a rotor shaft;

a power output shaft extending from said casing;

gear means, positioned in said gear chamber, for drivingly coupling said rotor shaft and said power output shaft;

air inlet means, extending into said casing, for admitting air containing a mist of lubricant into said motor chamber to rotate said rotor and rotor shaft, and thereby said power output shaft;

air silencer means, positioned on the exterior of said casing, for exhausting and muffling the air employed for rotating said rotor;

first passageway means, extending directly from said rotor chamber to said air silencer means, for passing a first portion of said air directly from said rotor chamber to said air silencer means; and second passageway means, extending from said rotor chamber to said gear chamber and then from said gear chamber to said air silencer means, for passing a second portion of said air from said rotor chamber to said gear chamber, for therein cooling and lubricating said gear means, and for then passing said second portion of said air to said air silencer means, said second passageway means comprising at least one inlet hole extending through said casing from said rotor chamber to said gear chamber and at least one outlet hole extending through said casing from said gear chamber to said air silencer means.

* * * * *